US009784432B2

(12) United States Patent
Allen et al.

(10) Patent No.: US 9,784,432 B2
(45) Date of Patent: Oct. 10, 2017

(54) OPTICAL ASSEMBLY WITH FORM-ANALOGOUS OPTICS FOR TRANSLUCENT LUMINAIRE

(71) Applicant: ABL IP Holding LLC, Conyers, GA (US)

(72) Inventors: Robert T. Allen, Green Bay, WI (US); Mark Jongewaard, Arvada, CO (US); Jamie R. Graves, Winona, MN (US); Dylan O. Jonsgaard, Winona, MN (US); Chad Hilton, Onalaska, WI (US)

(73) Assignee: ABL IP Holding LLC, Decatur, GA (US)

( * ) Notice: Subject to any disclaimer, the term of this patent is extended or adjusted under 35 U.S.C. 154(b) by 211 days.

(21) Appl. No.: 14/718,924

(22) Filed: May 21, 2015

(65) Prior Publication Data

US 2015/0338059 A1 Nov. 26, 2015

Related U.S. Application Data

(60) Provisional application No. 62/001,390, filed on May 21, 2014.

(51) Int. Cl.
*F21V 7/00* (2006.01)
*F21V 7/05* (2006.01)
(Continued)

(52) U.S. Cl.
CPC ..... *F21V 7/0033* (2013.01); *F21V 7/0066* (2013.01); *F21V 7/05* (2013.01);
(Continued)

(58) Field of Classification Search
CPC .... F21V 7/0033; F21V 7/0008; F21V 7/0016; F21V 7/0025; F21V 7/0041; F21V 7/0066; F21V 7/704; F21V 7/0704; F21V 13/10
See application file for complete search history.

(56) References Cited

U.S. PATENT DOCUMENTS 5,188,449 A * 2/1993 Davis ..... F21S 8/04 362/148
5,438,485 A * 8/1995 Li ..... B60Q 1/0011 362/298

(Continued)

*Primary Examiner* — Andrew Coughlin
*Assistant Examiner* — Christopher E Dunay
(74) *Attorney, Agent, or Firm* — Kilpatrick Townsend & Stockton, LLP

(57) ABSTRACT

An optical assembly includes a first reflector having a reflective surface with a first lateral extent, and a second reflector having a reflective surface with a smaller, second lateral extent. The second reflector is disposed such that the second reflective surface opposes the first reflective surface with a space therebetween. A light emitter couples with the first reflector such that the light emitter emits light along a central axis, away from the first reflector and toward the second reflector. A translucent diffuser substantially spans the space between the first and second reflectors. A majority of the light emitted by the light emitter reflects from the first and second reflectors, and impinges on and passes through the diffuser. A luminaire that includes the optical assembly also includes an outer shell having a form that is analogous to a shape of the diffuser of the optical assembly.

11 Claims, 6 Drawing Sheets

(51) Int. Cl.
*F21V 17/06* (2006.01)
*F21V 13/02* (2006.01)
*F21Y 115/10* (2016.01)

(52) U.S. Cl.
CPC ..... *F21V 13/02* (2013.01); *F21V 17/06* (2013.01); *F21Y 2115/10* (2016.08)

(56) References Cited

U.S. PATENT DOCUMENTS 6,473,554 B1 * 10/2002 Pelka ..... G02B 6/0018 385/146
7,722,220 B2 5/2010 Van De Ven
9,081,125 B2 * 7/2015 Dau ..... F21V 7/0008
9,109,781 B2 * 8/2015 Holder ..... F21V 5/008
2004/0246606 A1 * 12/2004 Benitez ..... G02B 3/02 359/858
2011/0103050 A1 * 5/2011 Hochman ..... F21K 9/00 362/231
2012/0320579 A1 * 12/2012 Ferguson ..... F21V 29/02 362/235
2013/0070462 A1 * 3/2013 Jin ..... F21V 7/04 362/298
2013/0201561 A1 * 8/2013 McCluney ..... F21S 11/00 359/597
2013/0294103 A1 * 11/2013 Li ..... F21K 9/54 362/555
2014/0002281 A1 * 1/2014 Jafrancesco ..... F21V 7/0033 340/985
2014/0313765 A1 * 10/2014 Nelson ..... F21K 9/52 362/555
2015/0211710 A1 * 7/2015 Speier ..... F21S 8/04 362/606
2015/0378088 A1 * 12/2015 Stormberg ..... F21S 8/06 362/606
2016/0076739 A1 * 3/2016 Hsiao ..... F21V 5/048 362/299
2016/0131331 A1 * 5/2016 Parker ..... G02B 6/0001 362/311.02
2016/0201862 A1 * 7/2016 Turnbull ..... F21V 3/0445 362/217.05
2016/0230955 A1 * 8/2016 Jang ..... F21V 7/0033
2016/0305619 A1 * 10/2016 Howe ..... F21K 9/27

* cited by examiner

OPTICAL ASSEMBLY WITH FORM-ANALOGOUS OPTICS FOR TRANSLUCENT LUMINAIRE

CROSS-REFERENCE TO RELATED APPLICATIONS

This application claims the benefit of U.S. Provisional Patent Application No. 62/001,390, filed May 21, 2014, which is incorporated by reference herein.

BACKGROUND

Existing suspended or ceiling-mounted luminaires that project light through translucent outer surfaces often utilize multiple light emitters (e.g., incandescent bulbs, fluorescent tubes and/or light emitting diodes (LEDs)) to provide light to the outer surfaces. Sometimes this approach has led to the surfaces not being evenly lit, that is, sometimes bright and/or dark spots are visually evident on the outer surfaces. A large number of individual sources can be used, but doing so can lead to manufacturing difficulties, high cost, high energy consumption and/or reliability issues due to the large number of sources and connections thereto.

SUMMARY

In an embodiment, an optical assembly includes a first reflector having a first reflective surface with a first lateral extent, and a second reflector having a second reflective surface with a second lateral extent that is smaller than the first lateral extent, the second reflector being disposed such that the second reflective surface opposes the first reflective surface with a space therebetween. A light emitter couples with the first reflector such that the light emitter emits light along a central axis of the optical assembly, away from the first reflector and toward the second reflector. A translucent diffuser substantially spans the space. A majority of the light emitted by the light emitter reflects from the first and second reflectors and impinges on and passes through the diffuser. In another embodiment, a luminaire that includes an embodiment of an optical assembly also includes an outer shell having a form that is analogous to a shape of the diffuser of the optical assembly.

In an embodiment, a method of providing light for a translucent luminaire having an outer shell includes emitting light from a light emitter, reflecting the light from at least a first reflector adjacent to the light emitter and a second reflector that opposes the first reflector, and passing the light through a diffuser having a form that is analogous to the form of the outer shell.

In an embodiment, a luminaire includes a reflector having a downwardly facing reflective surface with a first lateral extent, and a light emitter coupled with the reflector such that the light emitter emits light downwardly and in a direction of a central axis of the optical assembly, away from the reflective surface. A solid optic is disposed beneath the first reflector and the light emitter, and has a second lateral extent that is less than or equal to the first lateral extent. An upper surface of the solid optic forms an upwardly concave recess centered about the central axis. A suspension means suspends the solid optic beneath the first reflector. A translucent luminaire shell couples with one of the first reflector and the suspension means.

BRIEF DESCRIPTION OF THE DRAWINGS

The present disclosure is described in conjunction with the appended figures.

DETAILED DESCRIPTION

Certain embodiments herein include optical assemblies that illuminate a translucent luminaire from within. Such luminaires may be utilized in indoor or outdoor applications, and may emit light originating from compact sources, such as light-emitting diodes (LEDs). Although light emitting sources are sometimes referred to herein as LEDs, it is understood that incandescent, fluorescent, high-intensity discharge (HID), plasma, induction, organic LED (OLED) and other light emitter types may be substituted for LEDs without limitation. Certain ones of these light sources, such as LEDs, offer greater energy efficiency than others.

In certain embodiments, translucent luminaire is illuminated using one or more light emitting sources so that the source is obscured from direct view, with the light emitted by the source distributed evenly within the luminaire, that is, minimizing and/or eliminating bright or dark spots as seen by a viewer at a normal viewing distance. Presently available LEDs can emit large amounts of light from very small areas, which can lead to significant viewer discomfort and is sometimes perceived as a disincentive to utilize LEDs as light sources. However, the optical assemblies described herein can spread the light uniformly so as to minimize viewer discomfort and reduce energy consumption. Thus, embodiments herein provide translucent outer surfaces that are uniformly illuminated from within, while achieving high energy efficiency by utilizing LEDs as the light sources.

Figure 1A:
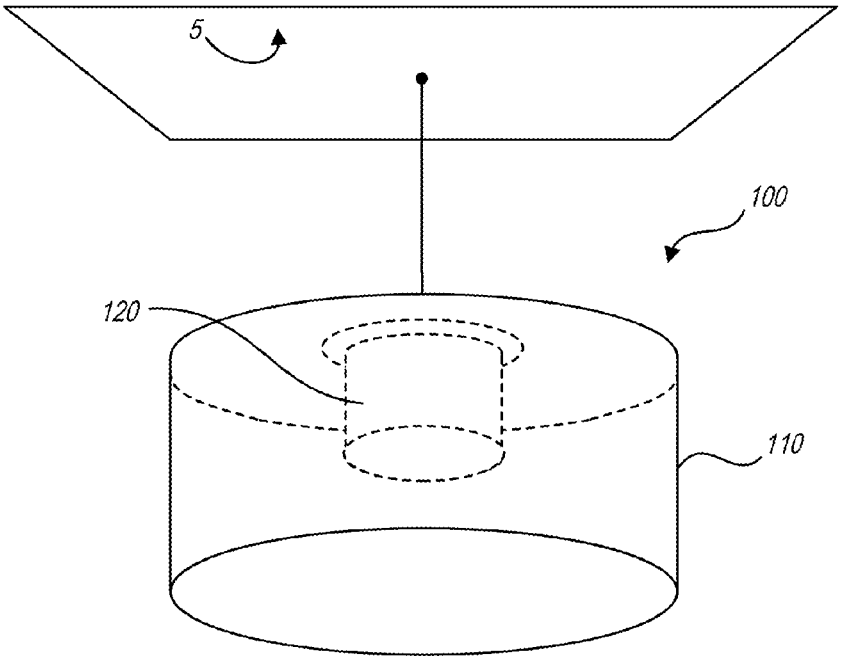
FIG. 1A schematically shows a suspended, drum shaped luminaire suspended from a ceiling, according to an embodiment.
Figure 1B:
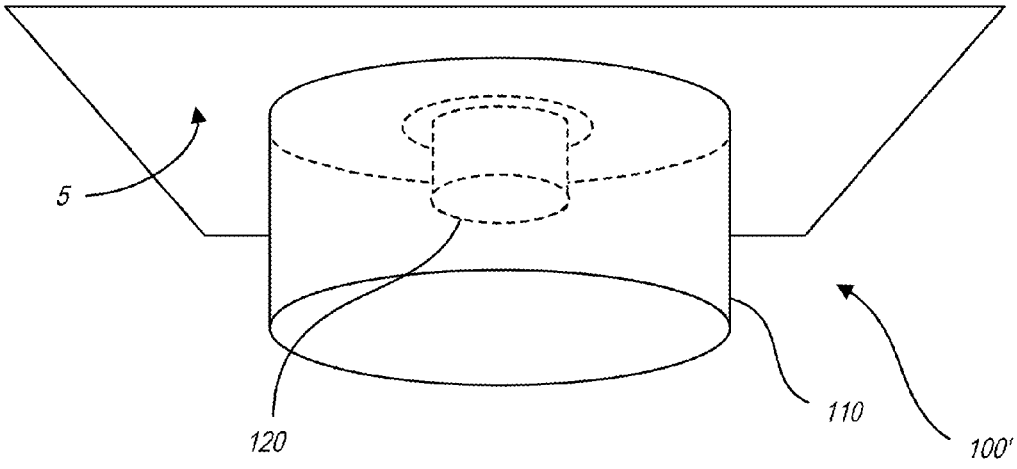
FIG. 1B schematically shows a ceiling mounted, drum shaped luminaire mounted with a ceiling, according to an embodiment.

FIG. 1A schematically shows a suspended, drum shaped luminaire 100 suspended from a ceiling 5, according to an embodiment. An outer shell 110 of drum shaped luminaire 100 is translucent, and is lit from within by a light spreading optical assembly 120 that includes a light emitter (not shown in FIG. 1A, see FIGS. 2-4). FIG. 1B schematically shows a ceiling mounted, drum shaped luminaire 100' mounted with ceiling 5; drum shaped luminaire 100' is mounted flush with ceiling 5 rather than being suspended from it, but is otherwise identical to luminaire 100.

Luminaires 100, 100' are specific cases of translucent luminaires that are generally symmetric about an emitter axis (that passes through optical assembly 120), although the form of symmetry may vary. That is, simple shapes such as cubes, pyramids and bowls centered about an emitter axis are considered symmetric. In each of luminaires 100, 100', optical assembly 120 provides luminous flux (e.g., light) that spreads from a central location within the luminaire to uniformly illuminate outer shell 110 from within. In other embodiments, outer surfaces of varying materials, shapes, sizes and aspect ratios are illuminated uniformly from high efficiency light sources.

Figure 2:
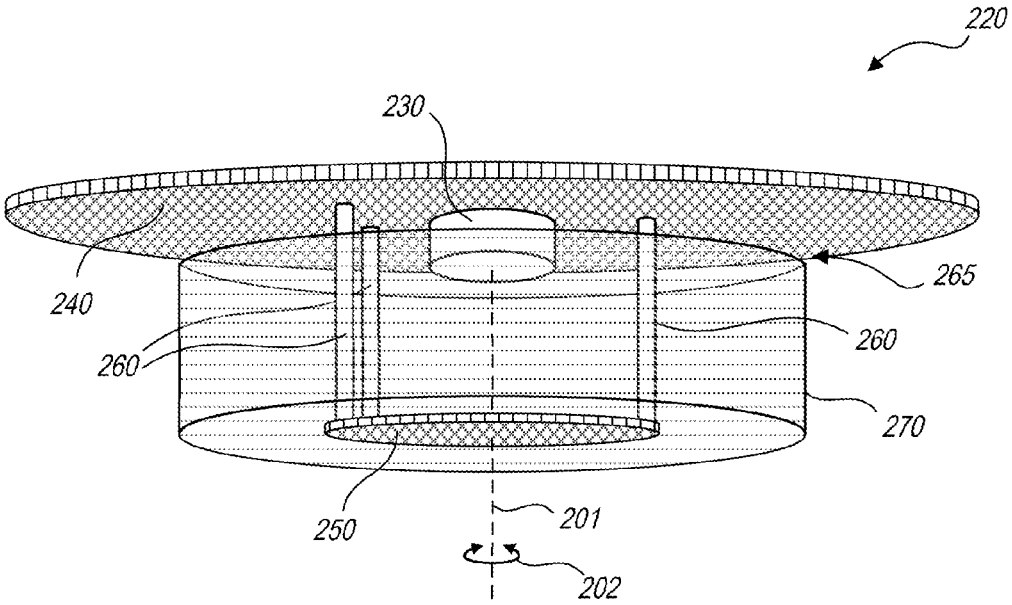
FIG. 2 schematically illustrates, in an upward perspective view, a light spreading optical assembly, according to an embodiment.

FIG. 2 schematically illustrates, in an upward perspective view, a light spreading optical assembly 220, which is an example of light spreading optical assembly 120, FIG. 1. Optical assembly 220 includes a first reflector 240 that, in use, may be disposed generally horizontally. As used herein, "generally horizontally" signifies that a plane defined by a light reflector (either because the light reflector is planar, or because it has a perimeter that defines the plane) is oriented within 10 degrees of horizontal when disposed such that central axis 201 is vertical. Of course, the fixtures herein could be mounted horizontally instead of vertically. A light emitter 230 is disposed such that first reflector 240 surrounds it laterally; that is, light emitter 230 defines a central axis 201 extending downwardly therefrom, and reflector 240 surrounds light emitter 240 in an azimuthal direction 202 about axis 201. Light emitter 230 emits light (generally downwardly, in the view of FIG. 2). A second reflector 250 reflects substantially all of the light from light emitter 230 (generally upwardly, in the view of FIG. 2) back towards the first reflector. As shown in FIG. 2, three support rods 260 couple second reflector 250 with first reflector 240; it is understood that the number of support rods utilized may vary in number and location to couple second reflector 250 with first reflector 240. A diffuser 270 extends laterally, substantially about second reflector 250 and support rods 260.

Optical assembly 220 provides a substantially uniform photometric distribution for a translucent luminaire in which it is located (such as, for example, luminaires 100, 100', FIGS. 1A, 1B). In some embodiments, the uniform photometric distribution results from all of the light from light emitter 230 impinging on diffuser 270 at least once before it spreads from assembly 220 to the translucent luminaire.

Type, shape, quality, finish and/or location components of optical assembly 220 may vary according to embodiments. Light emitter 230 may be for example one or more single LEDs, small LED based assemblies (including small arrays of individual LED chips or packaged LEDs), chip-on-board ("COB") LED-based modules, incandescent bulbs, or compact fluorescent lamps (CFLs). Advantageously, light emitter 230 is a very high efficiency light source, such as an LED based light source. In some embodiments, light emitter 230 is a COB module marketed under the brand names XSM or XLM, available from Xicato Corporation, San Jose, Calif.

First reflector 240 may be considered to define a reflective, upper, outer region for light spreading assembly 220. First reflector 240 is advantageously highly reflective and may be, for example, disc shaped, square, triangular, rectilinear, pentagonal, hexagonal, octagonal and the like. In some embodiments, first reflector 240 has a shape analogous to that of diffuser 270 and/or a luminaire shell that is utilized with optical assembly 220. That is, first reflector 240 may have a two-dimensional shape or outline, while diffuser 270 has a shape that is based on the two-dimensional shape or outline of first reflector 240, but is extended in the direction of central axis 201. Similarly, a luminaire shell (see, e.g., any of outer shells 110, FIGS. 1A, 1B or outer shells 510, 910, 1010, FIG. 5, 9 or 10 respectively) may have a shape that is the same as a corresponding diffuser, with a size that is larger than that of the diffuser. The term "reflective" is utilized herein to mean that an object efficiently distributes incident light, generally in a direction opposite to that from which the light originates; that is, the object does not absorb or transmit a substantial amount of the light. In this context, although first reflector 240 is reflective, it need not necessarily be a specular reflector. In certain embodiments first reflector 240 is a specular reflector, while in other embodiments, first reflector 240 is a diffuse reflector. When diffuser 270 is cylindrical, as shown in FIG. 2, first reflector 240 is advantageously a specular reflector in order to efficiently reflect rays that travel the farthest before impinging on diffuser 270 (e.g., rays that are emitted from light emitter 230 and bounce first from second reflector 250, then from first reflector 240, before reaching a lower corner of diffuser 270, where the side wall of diffuser 270 meets the bottom surface thereof). First reflector 240 may also be a diffuse reflector in some areas and a specular reflector in other areas. For example, first reflector 240 may be a specular reflector within a perimeter of diffuser 270, to maintain an outward directionality of rays that first reflect from second reflector 250, but may be a diffuse reflector at and outside the perimeter of diffuser 270. It can be seen in FIG. 2 and other drawings herein that light from light emitter 230 will first reflect from second reflector 250, then reflect from first reflector 240, that is, the "first" and "second" designations herein are based on mechanical arrangement in a typical top-to-bottom configuration, and are not based on the order in which light reflects from the two reflectors. In embodiments herein, reflectors may be formed of polished metal with or without reflection-enhancing coatings. Certain types of reflective metal with reflection-enhancing coatings that may be utilized are sold under the trade names Alanod Miro or Alanod Miro Silver, and provide reflectivity of 95% or higher for high efficiency (e.g., very little light is absorbed and converted to heat).

First reflector 240 may provide mechanical support to other elements of optical assembly 220 and/or a luminaire in which assembly 220 is located. For example, support rods 260 may attach to first reflector 240, with second reflector 250 and diffuser 270 attached thereto, when assembly 220 is in a horizontal orientation, as shown in FIG. 2. First reflector 240 may also provide mechanical support to an outer shell of a luminaire (see FIG. 5). First reflector 240 is advantageously a flat surface for ease and cost of manufacturing, but in certain embodiments is curved or contoured (see, e.g., FIG. 3) to spread light from a light emitter 230 as required for specific applications. First and second reflectors 240 and 250 (and/or other reflective components of light spreading assemblies herein) may be formed, for example, of metal (e.g., aluminum, steel, other metals, alloys), polymers, acrylics or polycarbonates; may be laminated, extruded, machined, molded, cast, fabricated, spun, stamped, hydroformed, formed by vapor deposition, or any combination thereof; and/or may be finished by painting, metalizing, anodizing, electrochemical deposition, printing or holographic infusion.

Second reflector 250 is disposed opposing first reflector 240 with a space therebetween, as shown in FIG. 2. Second reflector 250 may be highly reflective and typically has a smaller lateral extent (e.g., diameter or area) than first reflector 240. Second reflector 250 may be disc shaped or have some other shape that is analogous to the shape of first reflector 240 and/or diffuser 270. In many embodiments, particularly when diffuser 270 is drum-shaped, second reflector 250 is a diffuse reflector, but second reflector 250 may be a specular reflector in certain embodiments. Second reflector 250 can also provide mechanical support for diffuser 270 and/or a support rod that, in turn, supports an outer luminaire shell (see, e.g., FIG. 5). However, second reflector 250 can also sit inside diffuser 270 (see, e.g., FIG. 3). Second reflector 250 advantageously redirects a large amount of light propagating downwardly from light emitter 230 (e.g., toward nadir) that would otherwise form a bright spot immediately opposite light emitter 230. The light is substantially redirected toward first reflector 240, which further reflects the light downwardly and/or outwardly, as discussed above, but without a bright spot at nadir.

In one embodiment, support rods 260 support second reflector 250 and diffuser 270 when assembly 220 is in a horizontal orientation, as shown in FIG. 2. Support rods 260 are typically small in diameter and have a diffuse reflective finish to maintain light efficiency and minimize generation of bright or dark spots within a photometric distribution of assembly 220. That is, effects such as size of the light source in light emitter 230 (e.g., emitting light from an area instead of a point), and diffusion from first reflector 240, second reflector 250 and diffuser 270 provide enough scattering that shadowing due to support rods 260 is negligible. In some embodiments, support rods 260 are fabricated from a clear material to further minimize shadowing; in such cases, support rods may be rectilinear in cross-section and may be oriented such that light from light emitter 230 impinges at about normal incidence on faces thereof, so that the light passes through the support rod 260 without significant refraction, rather than the support rod acting as a cylindrical lens. Support rods typically pass through second reflector 250, such that finials or other mechanical fasteners can affix thereto and support second reflector 250.

It is understood that support rods 260 and mechanical fasteners attaching thereto are but one example of suspension means for supporting second reflector 250 from first reflector 240. Other examples include gluing support rods 260 to first reflector 240, second reflector 250 and/or diffuser 270, fabricating suspension means integrally with second reflector 250 and attaching the suspension means to first reflector 240, attaching diffuser 270 directly to first reflector 240 and coupling second reflector 250 thereto, and the like. Also, the number of support rods 260 may differ from those shown in FIG. 2. Two, four or more support rods 260 may be used.

Diffuser 270 is formed of a highly transmissive material that is either inherently diffusive (e.g., the material itself scatters light but does not absorb it) or has inner and/or outer surface finishes that are diffusive. Diffuser 270 transmits but diffuses all light that reaches it, typically after reflection and/or diffusion from one or more of second reflector 250 and first reflector 240. Accordingly, first reflector 240, second reflector 250 and diffuser 270 redirect all light emitted by light emitter 230 outwardly from an outer surface of diffuser 270, thus providing a three dimensional light source that "collects" and emits light evenly to surfaces of a surrounding luminaire. Diffuser 270 (and/or other translucent or transmissive components of light spreading assemblies herein) may be formed, for example, of polymers or polymer blends, silicones, acrylics or polycarbonates (such as Makrolon® polycarbonate, available from Bayer MaterialScience, a division of Bayer AG) in film, sheet or bulk forms; may be laminated, extruded, machined, molded, cast, thermoformed, vacuum formed, fabricated, glued, welded, spun, stamped, hydroformed, formed by vapor deposition, or any combination thereof; and/or may be finished by painting, metalizing, anodizing, electrochemical deposition, printing or holographic infusion.

Certain relative dimensions of components of light spreading optical assembly 220 are advantageous. For example, in some embodiments, diffuser 270 is shorter than support rods 260 such that a gap 265 forms between diffuser 270 and first reflector 240; gap 265 may facilitate air flow around, and heat dissipation from, light emitter 230. In other embodiments, diffuser 270 is as tall as support rods 260 such that diffuser 270 touches first reflector 240 (e.g., gap 265 is eliminated in such embodiments). Also, diffuser 270 may be large enough in comparison to second reflector 250 that outer rays of light originating at light emitter 230 that reflect from second reflector 250 and first reflector 240 do not reach gap 265 but instead impinge on diffuser 270, to avoid emitting high intensity reflections from assembly 220 through gap 265. Diffuser 270 may be cylindrical or drum shaped, as shown in FIG. 2, or may be shaped differently, such as having a semi-spherical shape, a bowl shape or a polygonal shape in horizontal cross-section, as discussed further below. To enhance luminous intensity and uniformity of light spreading optical assembly 220, first reflector 240 is typically larger than an upper perimeter of diffuser 270. Thus, first reflector 240 reflects not only light that is first reflected upwardly by second reflector 250, but also reflects light that is diffused outwardly and upwardly from diffuser 270.

Figure 3:
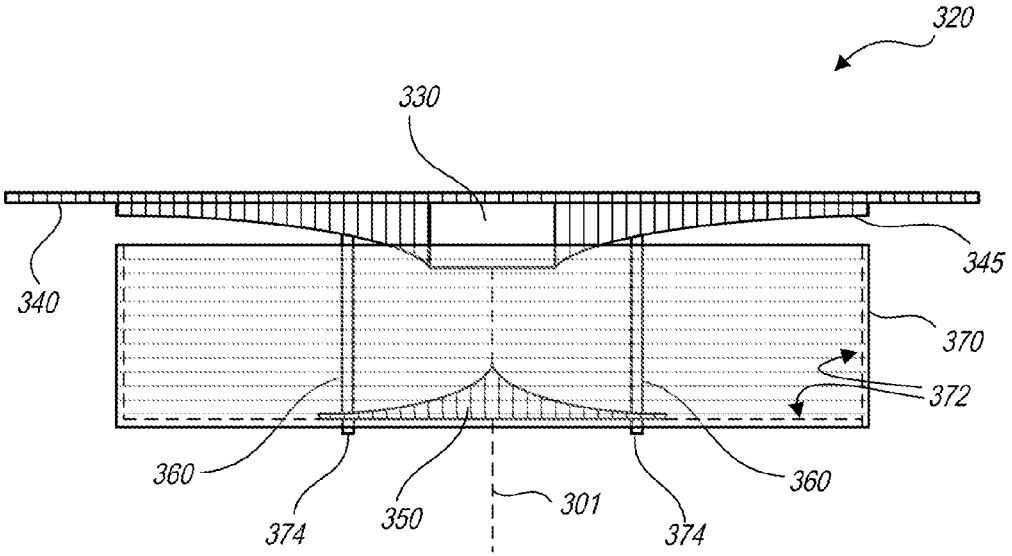
FIG. 3 schematically illustrates, in a cross-sectional view, a light spreading optical assembly that includes curved reflectors, according to an embodiment.

FIG. 3 schematically illustrates, in a cross-sectional view, a light spreading optical assembly 320 that includes sloped reflectors. Certain features shown in FIG. 3 are numbered congruently with and may be considered examples of the features shown in FIG. 2; for example a first reflector 340 is an example of first reflector 240, FIG. 2; a second reflector 350 is an example of second reflector 250, FIG. 2; a diffuser 370 is an example of diffuser 270, FIG. 2; etc. Optical assembly 320 includes first reflector 340 to which a light emitter 330 is coupled. Light emitter 330 emits light (generally downwardly, in the view of FIG. 3). Second reflector 350 forms a sloped shape that has a central point beneath light emitter 330 and forms upwardly concave curves that are symmetric about a central axis 301 of optical assembly 320. Second reflector 350 reflects substantially all of the light from light emitter 330 (generally upwardly, and outwardly from central axis 301, in the view of FIG. 3) back towards first reflector 340. Optical assembly 320 as shown in FIG. 3 also includes an optional third reflector 345 that directs reflections from second reflector 350 outwardly from central axis 301. In certain embodiments, third reflector 345 may be an additional part fitted about light emitter 330 or affixed to first reflector 340, while in other embodiments first reflector 340 may be fashioned with curved or angled surfaces to direct reflections outwardly without the addition of third reflector 345. In still other embodiments, reflectors can form conical and/or angled, planar surfaces to direct light as appropriate for specific applications.

As also shown in FIG. 3, a cylindrical diffuser 370 couples with support rods 360 and extends substantially about second reflector 350. The two support rods 360 that are shown could be representative of an arrangement of two, four, six or more support rods. In optical assembly 320, support rods 360 pass through second reflector 350, which rests on an internal surface 372 of diffuser 370. Finials or other fasteners 374 couple diffuser 370, with second reflector 350 resting thereon, with support rods 360.

Figure 4:
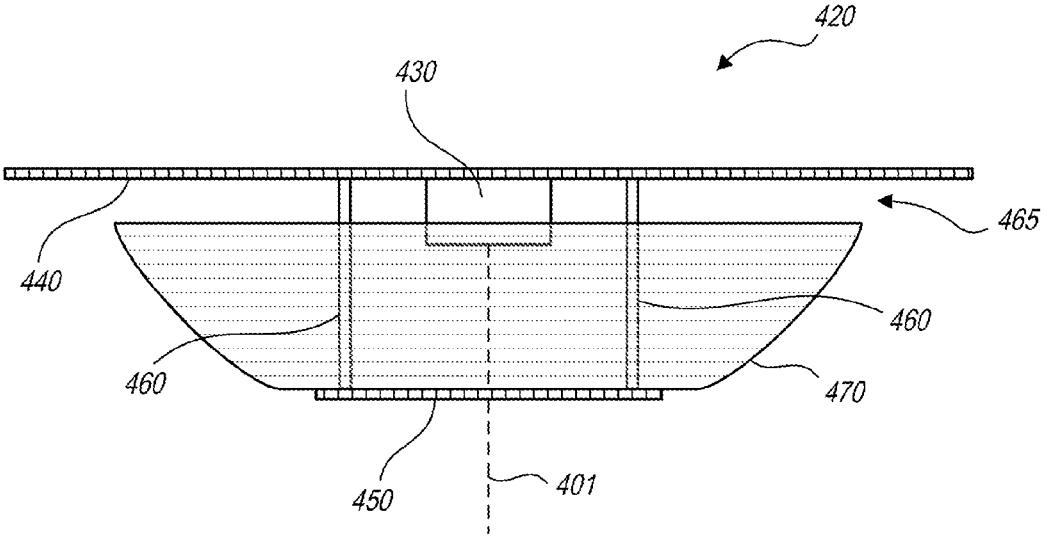
FIG. 4 schematically illustrates, in a cross-sectional view, a light spreading optical assembly, according to an embodiment.

FIG. 4 schematically illustrates, in a cross-sectional view, a light spreading optical assembly 420. Certain features shown in FIG. 4 are numbered congruently with and may be considered examples of the features shown in FIG. 2. For example, a first reflector 440 is an example of first reflector 240, FIG. 2; a second reflector 450 is an example of second reflector 250, FIG. 2; a diffuser 470 is an example of diffuser 270, FIG. 2; etc. In some embodiments, diffuser 470 is shorter than support rods 460 such that a gap 465 forms between diffuser 470 and first reflector 440; gap 465 may facilitate air flow around, and heat dissipation from, light emitter 430. In other embodiments, diffuser 470 is as tall as support rods 460 such that diffuser 470 touches first reflector 440 (e.g., gap 465 is eliminated in such embodiments). Optical assembly 420 includes first reflector 440 to which a light emitter 430 couples. Light emitter 430 emits light (generally downwardly, in the view of FIG. 4). Second reflector 450 reflects substantially all of the light from light emitter 430 (generally upwardly, in the view of FIG. 4) back towards the first reflector. As shown in FIG. 4, support rods 460 couple second reflector 450 with first reflector 440. Two support rods 460 are shown in FIG. 4; the support rods shown could be representative of an arrangement of two, four, six or more support rods. A bowl shaped diffuser 470 couples at least with second reflector 450 and extends substantially about second reflector 450 and support rods 460.

Optical assembly 420 provides a substantially uniform photometric distribution for a translucent luminaire in which it is located (such as, for example, luminaires 100, 100', FIGS. 1A, 1B). In some embodiments, the uniform photometric distribution results from all of the light from light emitter 430 impinging on diffuser 470 at least once (in some cases after reflecting/diffusing from first and second reflectors 440, 450) before it spreads from assembly 420 to the translucent luminaire.

Figure 5:
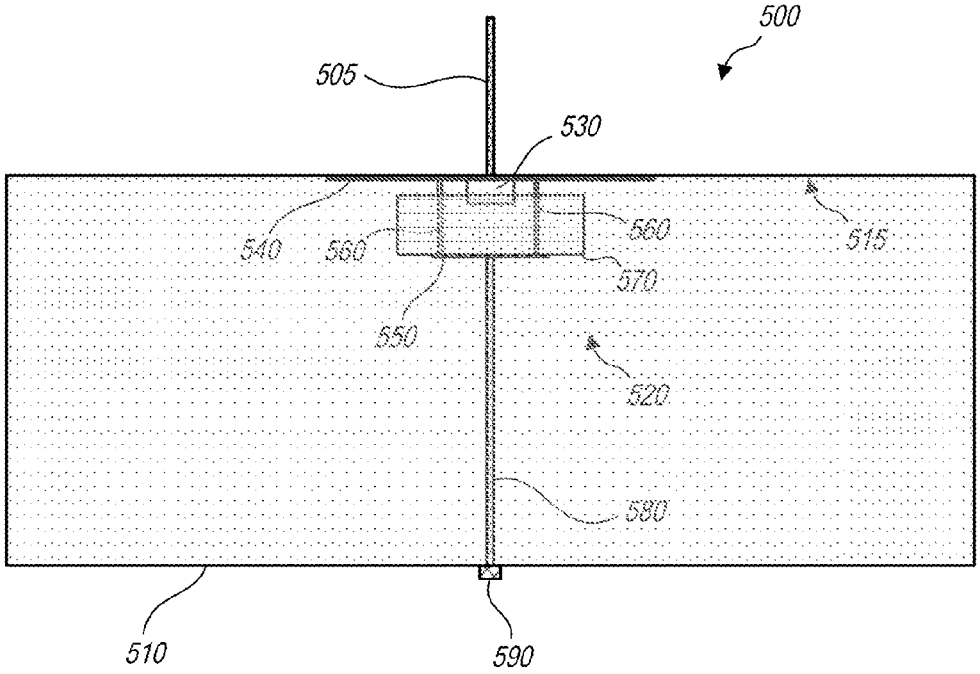
FIG. 5 schematically illustrates, in a cross-sectional view, a luminaire that includes a light spreading optical assembly, according to an embodiment.

FIG. 5 schematically illustrates, in a cross-sectional view, a luminaire 500 that includes a light spreading optical assembly 520. In optical assembly 520, a light emitter 530, a first reflector 540, a second reflector 550, support rods 560 and a diffuser 570 are equivalent to their like-named counterparts in optical assemblies 220 and 320, FIGS. 2 and 3, respectively. Luminaire 500 also includes an optional central support rod 580, to which a finial 590 attaches, at least partially supporting an outer shell 510 (first reflector 540 may also at least partially support outer shell 510). Like support rods as discussed above, central support rod 580 advantageously has a highly reflective and diffuse surface finish so as to reflect, rather than absorb, any light that strikes it. Finial 590 may be of any shape. Outer shell 510 is shown as cylindrical or drum-shaped in FIG. 5, but could be of any shape such as a cube, a bowl, an inverted pyramid, a sphere and the like. Light from light emitter 530 reflects and diffuses among first and second reflectors 540 and 550, and diffuser 570, eventually reaching outer shell 510. Outer shell 510 may be formed, for example, of one or more translucent materials such as acrylics or polycarbonates. Outer shell 510 may also be configured for visual interest by adding or forming complex shapes thereon, or by imprinting, wrapping and the like, with translucent or opaque materials. In some embodiments, an upper surface 515 of outer shell 510 is reflective so that any light reaching upper surface 515 is reflected downward to form part of the usable light output of luminaire 500. Equivalently, first reflector 540 may extend laterally to the extent of outer shell 510. Luminaire 500 may be ceiling mounted, or may be suspended from a ceiling by an optional support rod 505, through which power connections to light emitter 530 may be routed.

Figure 6:
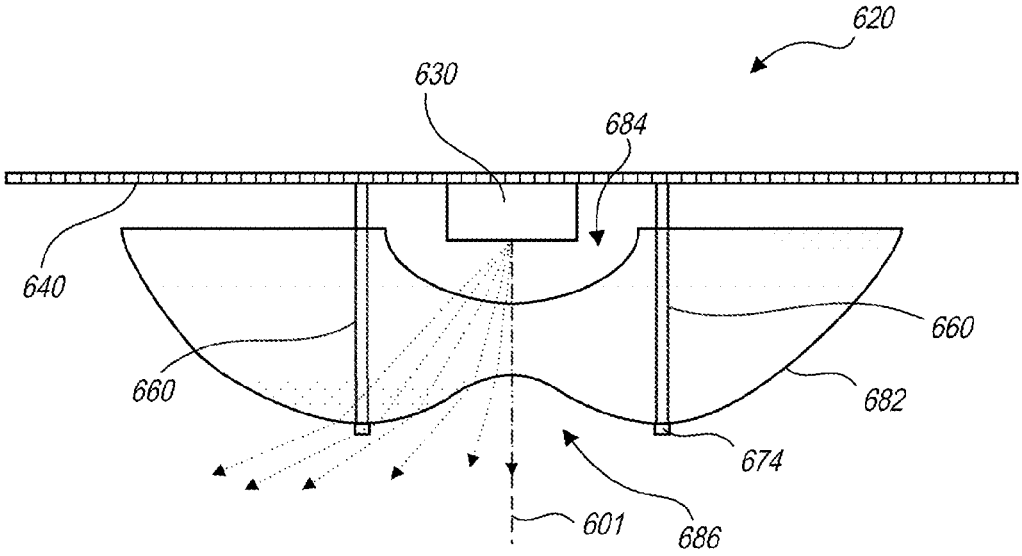
FIG. 6 schematically illustrates, in a cross-sectional view, a light spreading optical assembly that provides a substantially uniform photometric distribution for a translucent luminaire in which it is located.

FIG. 6 schematically illustrates, in a cross-sectional view, a light spreading optical assembly 620 that provides a substantially uniform photometric distribution for a translucent luminaire in which it is located (such as, for example, luminaires 100, 100', FIGS. 1A, 1B). Optical assembly 620 includes a first reflector 640 that has a downwardly facing reflective surface, to which a light emitter 630 couples. A central axis 601 is shown; when optical assembly 620 is installed with first reflector 640 oriented horizontally, one direction of central axis 601 is nadir, as shown. Light emitter 630 couples with first reflector 640, and emits light (generally downwardly in the view of FIG. 6, but with some lateral spread) toward a solid optic 682 that has a lateral extent (e.g., width in the view of FIG. 6) less than or equal to a lateral extent of the first reflector. Solid optic 682 generally refracts the light from light emitter 630, as shown by exemplary dotted line light rays. In certain embodiments, one or more surfaces of solid optic 682 are diffusive so that the light is also diffused somewhat (that is, the dotted line light rays represent where much of the light goes, with a percentage of the light scattered randomly). As shown in FIG. 6, support rods 660 couple with finials or other mechanical fasteners 674 to suspend solid optic 682 from first reflector 640. Two support rods 660 are shown in FIG. 6; the support rods shown could be representative of an arrangement of any number of support rods and represent a means for suspending solid optic 682 from first reflector 640.

In the embodiment shown in FIG. 6, solid optic 682 features a bowl shape with a first recess 684 and a second recess 686. First recess 684 is within an upper surface of solid optic 682 and is upwardly concave. First recess 684 allows air circulation about light emitter 630 to improve heat dissipation, and may help light from light emitter 630 couple into solid optic 682 by presenting a surface that is approximately normal to rays from light emitter 630 to minimize Fresnel reflections. The surface of recess 684 may have an antireflection coating. Second recess 686 is downwardly concave and is within a lower surface of solid optic 682. Second recess 686 advantageously steers light from emitter 630 away from the vertical, to spread the light throughout a luminaire that includes assembly 620. Aspects of second recess 686, such as whether the recess forms a smooth curve or comes to a tip beneath light emitter 630, and radii of curvatures of the downwardly concave shape of second recess 686 and/or the downwardly convex shape formed where second recess 686 meets upwardly sloping sides of solid optic 682, can be optimized to spread light from light emitter 630 as suitable for a given application.

Figure 7:
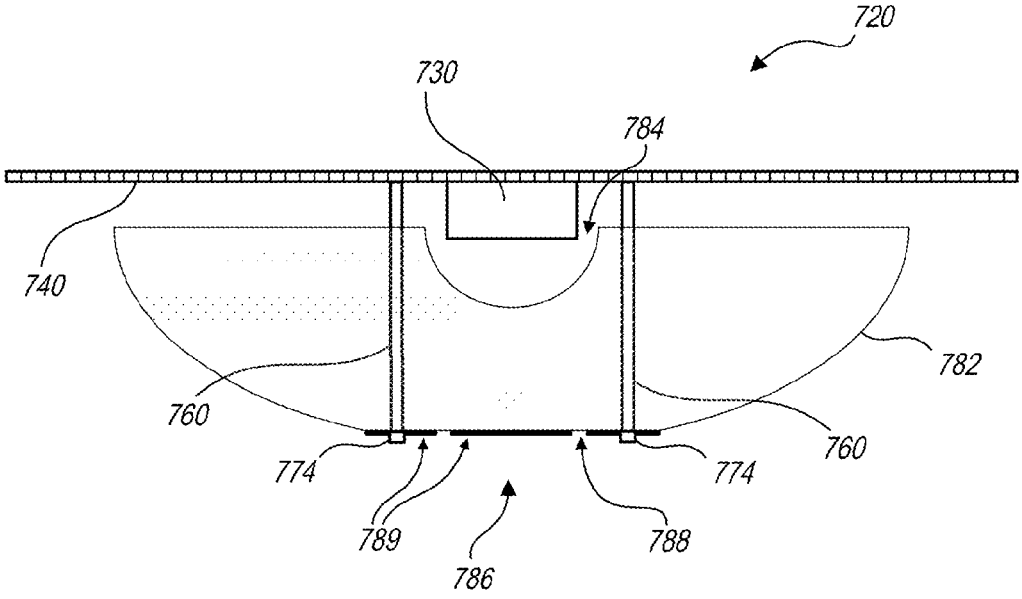
FIG. 7 is a schematic cross-section that illustrates a light spreading assembly, according to an embodiment.

In some embodiments, a solid optic can have a variety of surfaces that are selectively prepared as highly reflective, antireflective, transmissive and/or diffusive to tailor light delivered through the solid optic. FIG. 7 is a schematic cross-section that illustrates a light spreading assembly 720. Light spreading assembly 720 includes a solid optic 782 that is bowl shaped and forms a flat region 786 at the bottom. Support rods 760 and finials or other mechanical fasteners 774 support solid optic 782, which also has a recess 784 in the vicinity of a light emitter 730. Flat region 786 is selectively mirrored in mirrored portions 789, which reflect light from light emitter 730 back up through solid optic 782 for further reflection and diffusion from a first reflector 740. A portion of flat region 786, designated as surface portion 788, is not mirrored but instead is transmissive so that a portion of light from emitter 730 can emit therefrom. Surface portion 788 is advantageously diffuse so that portions of light from light emitter 730 that impinge thereon do not emit directionally but instead scatter as they are emitted from solid optic 782 (e.g., with a Lambertian characteristic, but other emission characteristics are possible). Mirrored portions 789 and diffuse surface portion 788 can be easily formed in a variety of shapes to help customize light distribution from light spreading assembly 720, as discussed below in connection with FIGS. 8A-8C.

Figure 8A:
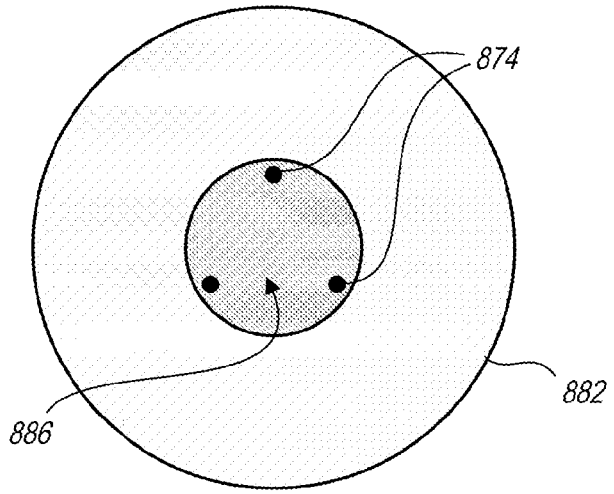
FIGS. 8A, 8B and 8C schematically illustrate ways in which mirrored and/or diffuse surfaces may be implemented on corresponding solid optics to provide a variety of light reflections and transmissions from the solid optics, according to embodiments.
Figure 8B:
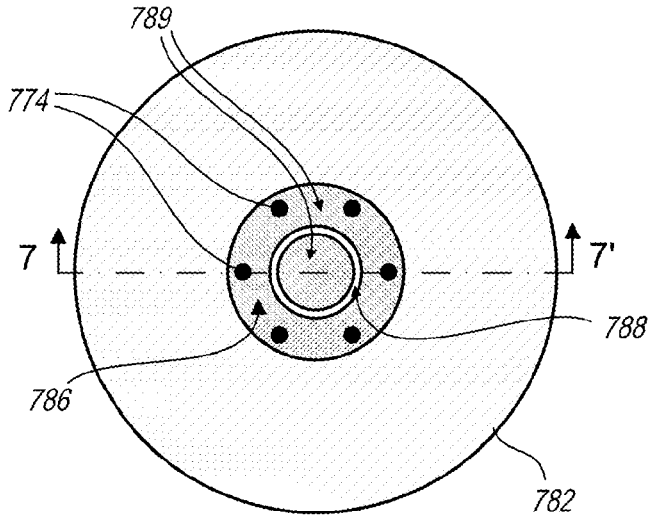
Figure 8C:
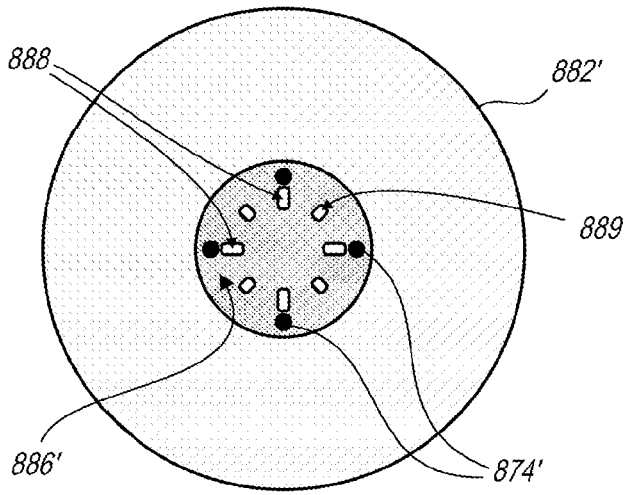

FIGS. 8A, 8B and 8C schematically illustrate ways in which mirrored and/or diffuse surfaces may be implemented on corresponding solid optics to provide a variety of light reflection and transmission from the solid optics. Each of FIGS. 8A, 8B and 8C is a bottom plan view of a solid optic as installed in a light spreading assembly.

FIG. 8A is a bottom plan view illustrating a solid optic 882 having a mirrored region 886 thereon. FIG. 8A also shows finials or other mechanical fasteners 874 that support solid optic 882 within a light spreading assembly.

FIG. 8B is a bottom plan view illustrating solid optic 782, FIG. 7. A broken line 7-7' indicates the cross-section shown in FIG. 7. Flat region 786 is mirrored in two mirrored portions 789, with a ring-shaped surface portion 788 defining a gap between the regions. Surface portion 788 may be formed, for example, by selectively masking solid optic 782 during the process of forming mirrored regions 789. Alternatively, surface portion 788 may be formed by first forming a mirrored surface across flat region 786, then masking mirrored areas that are to be preserved, and etching or abrading away the mirrored surface to form surface portion 788. This procedure may advantageously create a rough surface finish that will diffuse light transmitted toward surface portion 788 inside solid optic 782. FIG. 8B also shows finials or mechanical fasteners 774 that support solid optic 782 within light spreading assembly 720, FIG. 7.

FIG. 8C is a bottom plan view illustrating a solid optic 882' having a mirrored region 886' thereon. FIG. 8C also illustrates finials or mechanical fasteners 874' that support solid optic 882' within a light spreading assembly. FIG. 8C also illustrates apertures 888 and 889 that penetrate mirrored region 886' at discrete areas, but do not penetrate solid optic 882'. Like surface portion 788, FIG. 8B, apertures 889 may be formed either by selective masking during mirror formation or by selectively etching or abrading away the mirrored surface. Sizes, locations and shapes of apertures 888 and 889 may be adjusted as appropriate for a given application; for example apertures 888 are shown as slightly larger than apertures 889 to allow more light to pass through, to compensate for nearby finials or mechanical fasteners 874' blocking a portion of light from a light emitter.

Although not shown in FIG. 6 or 7, a luminaire including optical assemblies 620 and/or 720 (FIG. 7) mechanically couples a translucent shell with assemblies 620 or 720. Such mechanical coupling may suspend or couple the luminaire shell directly with the respective first reflectors 640, 740, similar to the structure shown in FIG. 5. Alternatively, such mechanical coupling may be indirect, for example by coupling the luminaire shell below solid optics 682, 782, obtaining support from support rods 660, 760 or other suspension means as are used for the respective solid optics.

Figure 9:
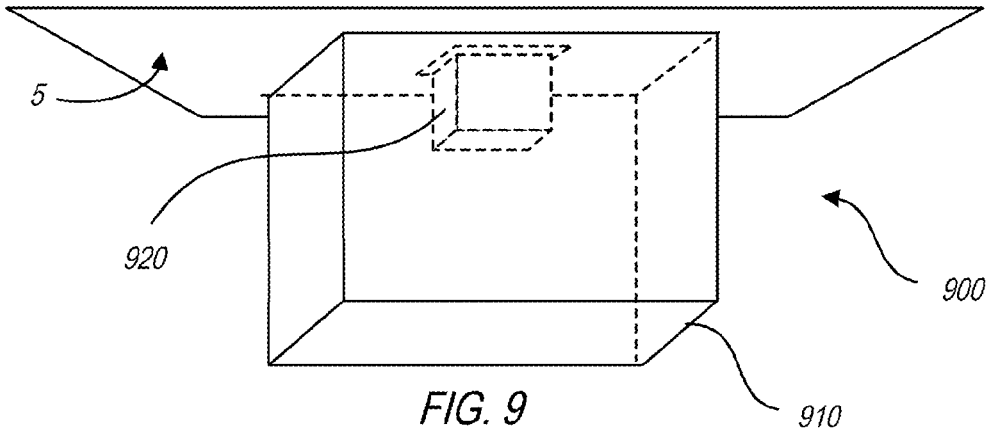
FIG. 9 schematically illustrates a cube-shaped luminaire that mounts with a ceiling and is illuminated from within by an optical assembly, according to an embodiment.
Figure 10:
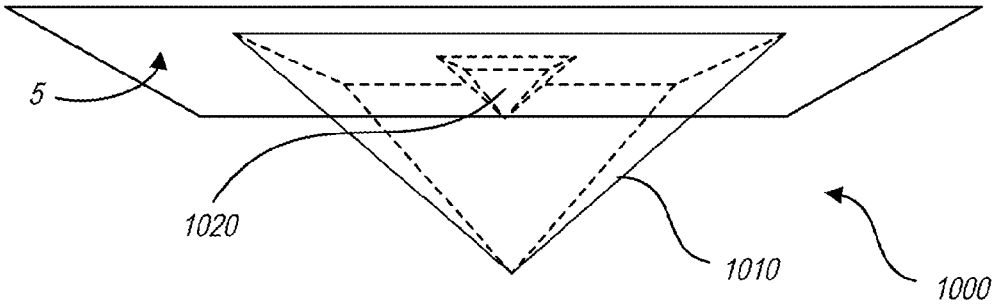
FIG. 10 schematically illustrates a pyramid-shaped luminaire that mounts with a ceiling and is illuminated from within by an optical assembly, according to an embodiment.

In embodiments, light spreading optical assemblies may be considered form-analogous optics, in that the light from such assemblies can project onto outer luminaire shells that have analogous forms, thus lighting the outer luminaire shells uniformly from inside. For example, FIG. 9 schematically illustrates a luminaire 900 having a cube-shaped luminaire shell 910 that is illuminated from within by an optical assembly 920. FIG. 10 schematically illustrates a luminaire 1000 having a pyramid-shaped luminaire shell 1010 that is illuminated from within by an optical assembly 1020. Each of optical assemblies 920, 1020 is a form-analogous optic in the sense that the shapes of their corresponding luminaire shells 910, 1010 are geometrically larger versions but of the same shape as their corresponding optical assemblies 920, 1020. Like optical assemblies 120, 220, 320, 420, 520, 620 and 720, optical assemblies 920, 1020 can have internal structures that provide uniform illumination from surfaces of the optical assemblies toward corresponding surfaces of luminaire shells 910, 1010. That is, the matching of analogous shapes of the optical assemblies with luminaire shells allows light to uniformly illuminate surfaces of the luminaire shells from corresponding surfaces of the optical assemblies.

Thus, although certain embodiments herein are drum-shaped luminaires of certain aspect ratios, alternate aspect ratios are contemplated, and different shapes such as bowls, cubes, pyramids, and others are contemplated.

Numerous specific details are set forth herein to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. A non-limiting list of variations that may be conceived of, includes:

- locating a light emitter such that it emits upwardly instead of downwardly;
- providing any type or shape of diffusion, partial reflectivity or total reflectivity on surfaces to provide light in particular directions;
- providing multiple light emitters;
- providing any manner of alternate suspension and/or attachment means for components such as diffuser(s), reflector(s) and outer luminaire shell(s);
- providing mechanical fasteners and parts thereof on or adjacent to one or more reflective surfaces such that the mechanical fasteners absorb, block or scatter incidental amounts (e.g., less than about 20%) of light that would otherwise reflect from the reflective surface(s);

providing additional reflector(s) and/or diffuser(s) to redirect portions of light within a luminaire, to maximize an amount and/or homogeneity of light reaching an outer shell of the luminaire;

mounting an optical assembly and/or a luminaire therein from a ceiling or suspending it therefrom;

when a luminaire is suspended, providing optical assemblies and/or outer luminaire shell(s) that emit a portion of light upwardly as well as outwardly/downwardly; and optimizing sizes, spacings and/or aspect ratios of features herein so as to provide light in particular directions, optimize heat dissipation and the like.

Accordingly, it should be understood that the present disclosure has been presented for purposes of example rather than limitation, and does not preclude inclusion of such modifications, variations and/or additions to the present subject matter as are noted above and/or would be readily apparent to one of ordinary skill in the art.

What is claimed, is:

1. An optical assembly, comprising:

a first reflector having a first reflective surface with a first lateral extent;

a second reflector having a second reflective surface with a second lateral extent that is smaller than the first lateral extent, the second reflector being disposed such that the second reflective surface opposes the first reflective surface with a space therebetween;

a light emitter that is disposed between the first reflector and the second reflector, and is coupled with the first reflector, such that the light emitter emits light along a central axis of the optical assembly, away from the first reflector and toward the second reflector; and a translucent diffuser, comprising:

a planar bottom surface that couples with the second reflector, and an annular peripheral wall that couples with the planar bottom surface about a periphery of the planar bottom surface, wherein:

an inner diameter of the annular peripheral wall is greater than a diameter of the second reflector, the peripheral wall substantially spans surrounds the space between the first and second reflective surfaces, and the light emitter, the first and second reflectors and the translucent diffuser being are arranged such that a majority of the light emitted by the light emitter reflects from the first and second reflectors, and impinges on and passes through the translucent diffuser as the light exits the space.

2. The optical assembly of claim 1, further comprising suspension means for suspending the second reflector from the first reflector.

3. The optical assembly of claim 2, the suspension means comprising a plurality of support rods.

4. The optical assembly of claim 1, wherein at least one of the first reflective surface and the second reflective surface is planar and is disposed generally horizontally.

5. The optical assembly of claim 1, wherein at least one of the first reflective surface and the second reflective surface is sloped such that light impinging thereon is reflected outwardly from the central axis.

6. The optical assembly of claim 1, wherein the diffuser completely spans the space such that the translucent diffuser touches both the first reflector and the second reflector.

7. The optical assembly of claim 1, wherein the diffuser partially spans the space such that a gap exists between the translucent diffuser and the first reflector.

8. A luminaire comprising:

the optical assembly of claim 1, wherein the translucent diffuser comprises a diffuser shape and a diffuser size;

and further comprising:

an outer shell having a shell shape and a shell size, wherein the shape of the diffuser and the shape of the outer shell are the same, and wherein the shell size of the outer shell is larger than the diffuser size of the diffuser, and wherein the shell shape is the same as the diffuser shape, at a larger scale.

9. The luminaire of claim 8, further comprising a support rod that couples with the second reflector and provides support for the outer shell.

10. The optical assembly of claim 4, wherein:

the first reflective surface is planar and disk shaped;

the second reflective surface is planar and disk shaped; and the first and second reflective surfaces are planar and are disposed parallel with one another.

11. The luminaire of claim 8, wherein:

the first reflector is disk shaped;

the second reflector is disk shaped;

the translucent diffuser shape is cylindrical;

the shell shape is cylindrical; and the first reflector, the second reflector, the translucent diffuser and the outer shell are arranged concentrically about the central axis of the optical assembly.

* * * * *